United States Patent [19]

Quigley

[11] 4,030,763

[45] June 21, 1977

[54] DICE GAME

[76] Inventor: Peter James Calvert Quigley, 9 Milton Road, Eastbourne, Sussex, England

[22] Filed: Jan. 29, 1976

[21] Appl. No.: 653,453

[52] U.S. Cl. ..... 273/134 D; 273/137 C; 273/137 D; 273/146

[51] Int. Cl.[2] ..... A63F 9/14

[58] Field of Search ..... 273/130 R, 130 E, 137 R, 273/137 B, 137 C, 137 D, 138 R, 131 R, 131 A, 131 AD, 131 AC, 131 AB, 131 BB, 131 B, 131 BA, 131 C, 131 D, 131 E, 131 F, 131 G, 131 L, 131 K, 131 KC, 131 KN, 131 KP, 131 T, 134 AD, 134 CH, 134 AC, 134 C, 134 D, 134 CF, 135 AA, 135 F, 146

[56] References Cited

UNITED STATES PATENTS

| | | | |
|---|---|---|---|
| 1,520,011 | 12/1924 | Clark | 273/146 UX |
| 1,597,419 | 8/1926 | Anderson | 273/134 AD |
| 2,560,187 | 7/1951 | Post | 273/146 |
| 2,611,616 | 9/1952 | Kloss | 273/134 D |
| 3,929,337 | 12/1975 | Hayes | 273/137 R X |

FOREIGN PATENTS OR APPLICATIONS

| | | | |
|---|---|---|---|
| 694,880 | 7/1953 | United Kingdom | 273/134 C |

*Primary Examiner*—Richard C. Pinkham
*Assistant Examiner*—Arnold W. Kramer
*Attorney, Agent, or Firm*—Fleit & Jacobson

[57] ABSTRACT

A dice game for two or more players comprises a playing die bearing a variety of markings, a set of a plurality of playing pieces for every player, each playing piece being polygonal in plan view when placed on any convenient playing surface and bearing a marking identical with one of the markings on the die, and a plurality of direction indicators for placing on the playing surface so as to prescribe a general path to be followed by the playing pieces over the playing surface. The rule of the game is that each player must move his playing pieces towards and around the direction indicators so that at the end of each move the pieces remain juxtaposed in face-to-face contact at their sides to form a line or snake. During the game, the line or snake of playing pieces is advanced by successively removing the hindmost playing piece and placing it at the front, finishing with the piece that has the same color as that indicated by the throw of the die.

7 Claims, 5 Drawing Figures

DICE GAME

The invention relates to a dice game that can be played by at least two players without a board.

It is an object of the invention to provide a game that resembles a board game in so far that pieces are to be moved by the players in turn but that can be played on an unprepared playing surface, such as a floor. It is a further object of the invention to provide a game that will be found amusing and interesting by children of pre-school and early school age.

According to the present invention, a game for playing on a flat playing surface by at least two players comprises at least one playing die bearing a variety of markings for determining each player's moves by chance depending on which marking on the die is indicated after a throw, a set of a plurality of playing pieces for every player, each playing piece being polygonal in plan view when placed on the playing surface and bearing a marking identical with one of the markings on the die, and a plurality of direction indicators for placing on the playing surface so as to prescribe a general path to be followed by the playing pieces over the playing surface.

By the term 'die' I mean to include not only the very well known cuboidal blocks conventionally supplied with games but also other devices that are used to determine a player's move by chance, for example a spinner unit comprising a stem projecting at right-angles through a polygonal disc bearing different markings adjacent each of its edges, the 'throw' being executed by spinning the disc with the aid of the stem and the indication of the player's move being given by the marking adjacent that edge of the polygonal disc on which it comes to rest after spinning.

Preferably, the game of the present invention includes as many playing pieces in each set as there are different markings on the die, desirably six. Preferably also, the markings on the die, and hence on the playing pieces, are not the conventional dots representing various numbers but in the form of different colours, the term colour here being understood to include white and black if so desired.

Examples of the invention will now be described with reference to the accompanying drawings, wherein.

Figure 1:
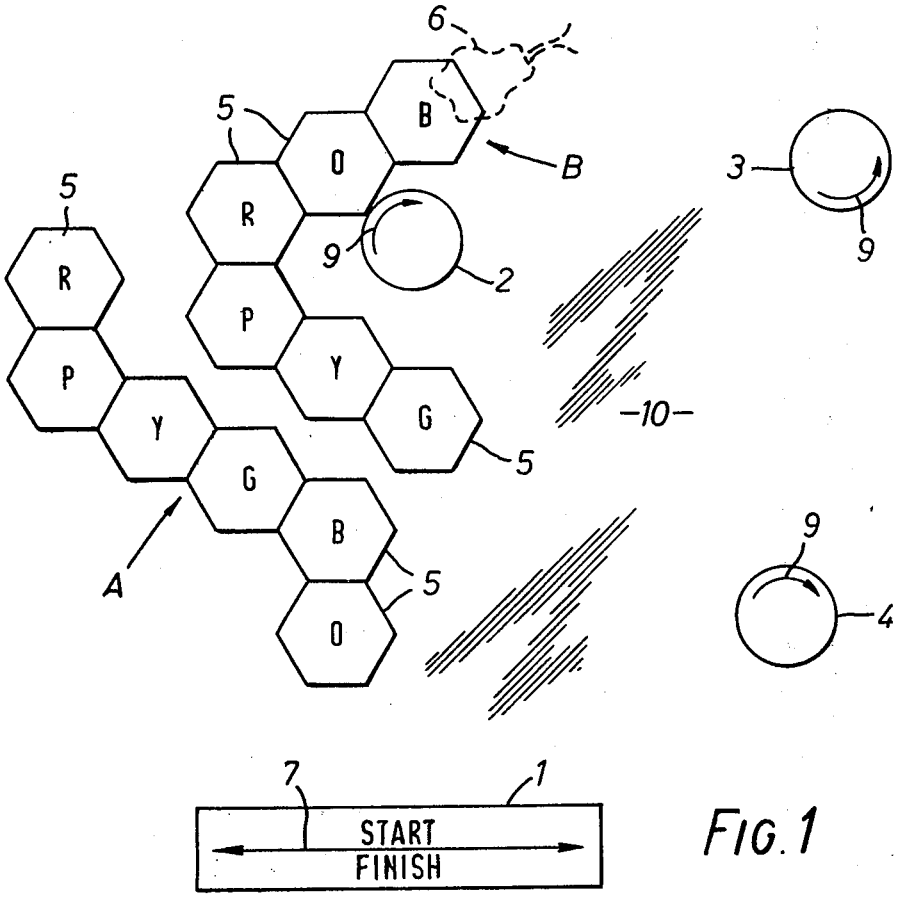
FIG. 1 is a plan view of the game showing the playing pieces of two players set out on a playing surface and in the course of play.
Figure 2:
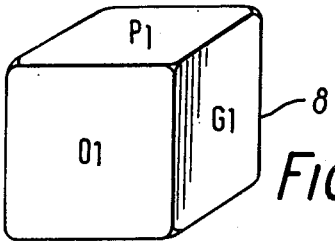
FIG. 2 is a perspective view of a suitable die for use with the game.
Figure 3:
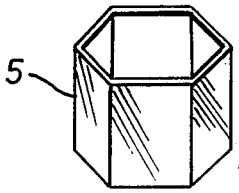
FIG. 3 is an underneath perspective view of one of the playing pieces.

In the FIGS. 1 to 3 example of the invention, FIG. 1 shows the components of the game for two players set out on a flat playing surface such as a floor or carpet 10. A marker 1, which may be a flat strip of material, indicates a starting and finishing line 7. Direction indicators 2, 3, 4 in the form of discs or cylinders bearing arrows 9 on one side or end face (the arrows may be reversed on the reverse side or end face) serve to show the general path to be followed by each set of playing pieces 5. The playing pieces themselves are in the form of hollow hexagonal blocks (also see the underplan of FIG. 3) of moulded plastics material having a flat top and sides but no base. Alternatively, the playing pieces may be solid blocks or flat plates. At least the top of each hollow block, but preferably the entire block, is of a distinctive colour different from the colour of all the other blocks in the same set. There are as many sets of playing pieces as there are players and all the sets are identical. In the illustrated case, each of two sets A, B comprises six differently coloured playing pieces 5 identified by the letters Y, G, B, O, R and P representing yellow, green, blue, orange, red and purple, respectively. A substantially cuboidal die 8 (FIG. 2), or one such die for each player, has each of its sides of the same colour as one of the playing pieces in the set, instead of bearing the usual dots. In FIG. 2, the sides coloured orange, green and purple are visible and are for the purpose of illustration herein identified as $O_1$, and $G_1$ and $P_1$, respectively. A conventional die with one dot on one side, two dots on another, and so on, up to six dots could be used instead but in that case the tops, and preferably also the sides, of the playing pieces 5 in each set A, B would similarly be identified with dots instead of colours.

The rule of the game is that each player must move his playing pieces 5 so that at the end of each move the pieces remain juxtaposed in face-to-face contact at their sides to form a line or snake. At the start of the game, each set A, B is assembled in a line in front of the starting line 7 and at right-angles thereto. The position on the playing surface 10 of the marker 1 bearing the starting and finishing line 7 may be chosen at will. The sequence of the colours of adjoining playing pieces at the start may also be haphazardly chosen or stipulated by the rules. The locations of the direction indicators 2, 3, 4 on the playing surface 10 are similarly selected at will. During the game, the line or snake of playing pieces 5 is advanced by successively removing the hindmost playing piece and placing it at the front, finishing with the piece that has the same colour as that indicated by the throw of the die 8, i.e. the uppermost colour of the die. The first player with his playing pieces back over the line 7 after having completed the course and negotiated the obstacles constituted by the direction indicators 2, 3, 4 is the winner. The lines or snakes of the players may not intersect one another.

In FIG. 1 of the drawings, the sets A, B of playing pieces 5 of two players are shown during the course of a game. Set B has the advantage of being nearest the obstacle 2. Set A may not cross the line of set B and must therefore be moved around set B to circumnavigate obstacle 2 and approach obstacle 3. If the player of set A throws purple on the die 8, he first moves the orange piece 0 to the head of the line, then the piece B, and so on, and finally the purple pieces P, each time building onto a vacant side of the leading hexagonal piece 5 to follow the shortest possible path to the obstacle 3 around the obstacle 2 in the direction of the arrow 9 thereon. If he is fortunate with his throws of the die 8 and the player of set B is less fortunate, set A could eventually catch up and cut off set B.

It will be evident that each set A, B of playing pieces resembles a snake that is slithering its way from start to finish in the course of a game. To simulate the head of the snake and thereby serve as an indicator for the direction of movement of the playing pieces 5, each player may be provided with a capping piece, such as indicated in broken lines at 6 in FIG. 1. After each move, the player places the capping piece 6 on the leading playing piece 5 of his set so that he may more readily recognise the leading end.

In a variation of the game, the rules may state that, if a player happens to throw with the die 8 the same colour as appears on the trailing playing piece of his set, then he is penalised and must reverse the direction of movement of his set and consequently place the capping piece 6 on what was until then the trailing playing piece to make it the now leading playing piece.

Figure 4:
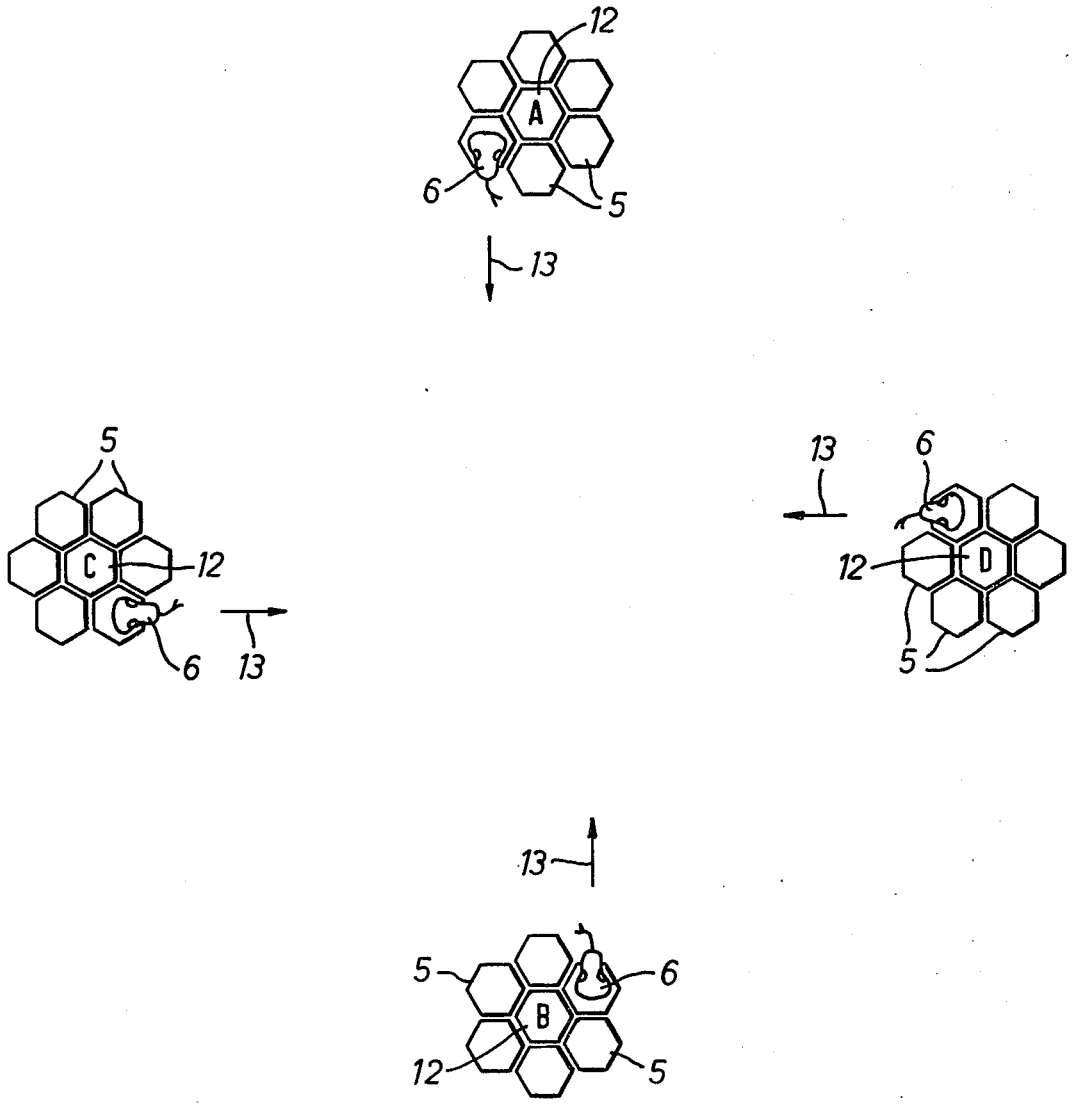
FIG. 4 is a plan view of a modified game showing the playing pieces for four players before play has commenced.

In the modification of the game shown in FIG. 4, similar references are used to indicate the same components that are used in the game of FIG. 1. The principal differences in FIG. 4 are, firstly, that no marker is necessary to indicate a starting and finishing line and, secondly, that each direction indicator 12 is of the same hexagonal shape and size as the playing pieces 5, there being as many direction indicators as there are sets of playing pieces. The direction indicator 12 of each set is a neutral colour, i.e. a colour different from that of every playing piece 5. The direction indicators are here referenced by the letters A to D merely to identify the four different sets for illustrative purposes. Before commencement of the game, the four direction indicators 12 are placed on the playing surface at substantially equal spacings from one another so that the distance between the direction indicators of directly oppositely facing sets A and B is the same as that between those of the oppositely facing sets C and D. The playing pieces 5 of each set are placed around the respective direction indicator in face-to-face relationship with the sides and the capping piece 6 is positioned on one of the pieces 5 so as to point towards the opposite set, as indicated by the arrows 13. During the game, each player moves his line or snake towards and around the direction indicator of the directly opposite set and then back again to the starting position, the first player to be back being the winner. It will be evident that, during the game, the various sets of playing pieces will impede each other's course, it being a rule that no line of playing pieces may intersect another. This version of the game can also be played by two or any other number of players.

Figure 5:
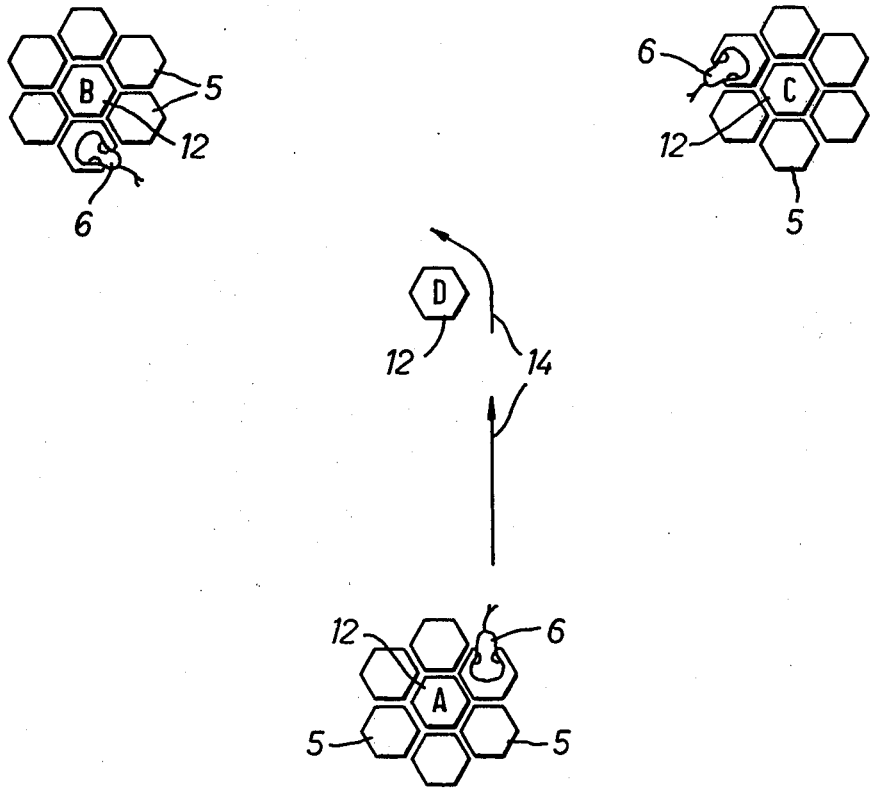
FIG. 5 is a plan view of the FIG. 4 game but set out for three players.

For three players, it is preferred initially to set out the playing pieces 5 with direction indicators 12 at the corners of a triangle in the manner shown in FIG. 5, the spare direction indicator 12 of the unused fourth set D being placed in the centre to serve as an additional obstacle. Each player must move his pieces 5 behind the central indicator D towards and around one of the other indicators as indicated by the arrows 14, 14 and then back again to the starting position.

In all versions of the game, must of the fun and interest of play comes in having to take account of the movements of rival snakes or lines. Since the snakes must always pass round each other, this creates ever new hazards for one another.

I claim:

1. A game for playing on a flat playing surface by at least two players, comprising at least one playing die bearing a variety of markings for determining each player's moves by chance depending on which marking on the die is indicated after a throw, at least two sets of a plurality of playing pieces, one set for each player, each set having the same number of pieces, each playing piece of a set being polygonal in plan view when placed on the playing surface and bearing a different respective marking identical with one of the respective variety of markings on the die, and a plurality of direction indicator means for placing on the playing surface, each and for indicating a direction of travel so as to prescribe a general path to be followed by the playing pieces over the playing surface.

2. A game according to claim 1, wherein there are as many playing pieces in each set as there are different markings on the die.

3. A game according to claim 2, comprising six playing pieces in each set.

4. A game according to claim 1, wherein the die is provided with markings in the form of different colours.

5. A game according to claim 1, wherein each playing piece is hexagonal in plan view.

6. A game according to claim 1, wherein each direction indicator means is of the same shape and size as the playing pieces.

7. A game according to claim 6, wherein there are as many direction indicator means as there are sets of playing pieces.

* * * * *